US011598114B2

(12) United States Patent
Tan

(10) Patent No.: US 11,598,114 B2
(45) Date of Patent: Mar. 7, 2023

(54) DYNAMICALLY ORIENTING ADJUSTABLE SHELTER

(71) Applicant: Kristopher Bradley Tan, Shalimar, FL (US)

(72) Inventor: Kristopher Bradley Tan, Shalimar, FL (US)

( * ) Notice: Subject to any disclaimer, the term of this patent is extended or adjusted under 35 U.S.C. 154(b) by 6 days.

(21) Appl. No.: 17/459,906

(22) Filed: Aug. 27, 2021

(65) Prior Publication Data

US 2022/0064980 A1 Mar. 3, 2022

Related U.S. Application Data

(60) Provisional application No. 63/071,168, filed on Aug. 27, 2020.

(51) Int. Cl.
*E04H 15/42* (2006.01)
*E04H 15/32* (2006.01)

(52) U.S. Cl.
CPC ..... *E04H 15/42* (2013.01); *E04H 15/322* (2013.01)

(58) Field of Classification Search
CPC ..... E04H 15/42; E04H 15/322; E04H 15/58
See application file for complete search history.

(56) References Cited

U.S. PATENT DOCUMENTS 2,554,688 A * 5/1951 Vollweiler ..... A45F 4/04 383/4
2,660,186 A * 11/1953 Marshall ..... E04H 15/003 135/153
3,042,053 A * 7/1962 Effie ..... E04H 15/003 135/130
3,070,107 A * 12/1962 Beatty ..... E04H 15/003 D30/118
3,075,536 A * 1/1963 Parker ..... E04H 15/003 D21/837
4,860,504 A * 8/1989 Lawrence ..... E04H 15/58 135/900
7,789,097 B1 * 9/2010 Sotirkys ..... E04H 15/06 135/88.01
8,720,461 B2 * 5/2014 Nichols ..... E04H 15/58 135/117
9,051,756 B1 * 6/2015 Jenkins ..... E04H 15/58
10,190,330 B2 * 1/2019 Barnes ..... E04H 15/30

FOREIGN PATENT DOCUMENTS

WO WO-2011150477 A1 * 12/2011 ..... E04H 15/40

* cited by examiner

*Primary Examiner* — Noah Chandler Hawk
(74) *Attorney, Agent, or Firm* — AdamsIP, LLC; Edward Brinkley Garner, III; James H Adams

(57) ABSTRACT

A system for a dynamically orienting adjustable shelter is provided. The system generally comprises a base, lever arm, counterweight, boom, canopy, canopy supports, and support cables connected to said canopy supports. The boom and lever arm connect to the base in a way such that the boom may be in an upright position when a counterweight is placed on the lever arm. A canopy assembly may be rotatable attached boom in a way that allows it to rotate about said boom, which allows the canopy assembly to reduce the cross-sectional area of the canopy exposed to the wind. A cable may be attached to the front end of the canopy supports, which may prevent the back end of the canopy from tipping too far down when there is no wind that the system may use to stabilize the canopy by naturally reducing the cross-sectional area exposed thereto.

22 Claims, 7 Drawing Sheets

DYNAMICALLY ORIENTING ADJUSTABLE SHELTER

This application claims the benefit of U.S. Provisional Application No. 63/071,168, filed on Aug. 27, 2020, wherein said Provisional Application is incorporated herein by reference.

FIELD OF THE DISCLOSURE

The subject matter of the present disclosure refers generally to a system that may act as a shelter from the elements in windy conditions.

BACKGROUND

As tents and pop-up canopies have become lighter and less expensive, it is becoming increasingly common for beachgoers to bring them as shelter should a storm surprise them or as a temporarily escape from the sun. However, tents and pop-up canopies tend to affect the beauty of the surround area by acting as an impenetrable wall through which no one can see. Additionally, trashed tents and pop-up canopies have become a major source of frustration for many municipalities since beachgoers often leave broken pop-up canopies and tents at the site in which they broke. This trash can create a danger to beachgoers since many of these tents and pop-up canopies contain metal that could potentially pose tetanus risks should an unsuspecting beachgoer step on a buried piece of the metallic trash. It can also pose problems for wildlife since the tensile material may act as a net from which wildlife may have trouble escaping.

One of the primary reasons current tents and pop-up canopies break is due to drag forces created by wind acting on the tensile materials. This is particularly true at the beach where winds often reach more than twenty miles per hour. The supporting structures of many tents and pop-up canopies are simply not designed to withstand much force, and in those types of conditions, the tensile materials act very much like parachutes, subjecting the frames to more force that originally designed. Even if the tents and pop-up canopies are designed to withstand more forces than the average tent/pop-up canopy are designed to withstand, the structures are often not designed to withstand forces in the way wind may apply them. This results in the destruction of the underlying structure, resulting in beachgoers leaving them behind as unsightly and potentially dangerous trash for others to collect. Even if the tent and pop-up canopies don't break, they still may be prone to flipping in windy conditions due to the drag forces acting on the tensile materials. These types of scenarios can lead to shelters taking flight with the wind and present a danger to surrounding people and property. Further, wind resistant tents currently known in the art are either wind-supported (and thus do not provide equal functionality on a windless day) or are not large enough to host multiple standing people.

Accordingly, there is a need in the art for a canopy system that may be subjected to large gusts without sustaining damage, present a low flyaway risk, and provide shelter with or without the presence of wind while limiting obstruction of the surrounding scenery.

SUMMARY

A system for a dynamically orienting adjustable shelter is provided. Generally, the system of the present disclosure is designed to provide the user a shelter in the form of a canopy that may protect the user from the elements during both windy and non-windy conditions. Alternatively, the system may be used as a portable shelter for rainy conditions in areas in which no or limited shelter may be available. The system generally comprises a base, lever arm, counterweight, boom, canopy, canopy supports, and support cables connected to said canopy supports. In one preferred embodiment, the system may further comprise a boom extension that may increase the length of the boom. In another preferred embodiment, the system may further comprise a plurality of tension straps that may be used to adjust the angle of the canopy supports.

The base comprises an extruded shape having a first end and a second end. In a preferred embodiment, the extruded shape is a cylinder. An outer wall of the base comprises a first aperture configured to fit a base end of the lever arm and second aperture configured to fit a bottom end of said boom. The lever arm connects to the base at said base end and a weight end extends away from said base such that the center of gravity of a counterweight attached to said weight end is in a position extending outward from and approximately central to a central point of said base. The counterweight preferably has a weight sufficient to overcome the torque created by the drag force acting on the canopy, the canopy weight, and the boom with the torque created by itself and the lever arm, wherein the drag force at a certain wind velocity may become large enough such that the torque created by the counterweight and lever arm may be overcome and the base may rotate the canopy back and eventually down.

The boom connects to the base at said bottom end and a canopy end extends away from said base at an angle from said lever arm that may allow a canopy support to be supported at an elevated position. In a preferred embodiment, the system comprises a first boom and second boom that functionally connects to said canopy support on a first side and second side. In a preferred embodiment, the canopy supports are attached to the boom in a way that allows it to rotate about said boom. By attaching the canopy support in this manner, the system may automatically adjust to windy conditions by allowing the canopy to naturally reduce the wind drag by causing the canopy support to rotate about the booms, which reduces the cross-sectional area of the canopy exposed to the wind. A cable may be attached to the front end of the canopy supports, which may prevent the back end of the canopy from tipping too far down when there is no wind that the system may use to stabilize the canopy by naturally reducing the cross-sectional area exposed thereto.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
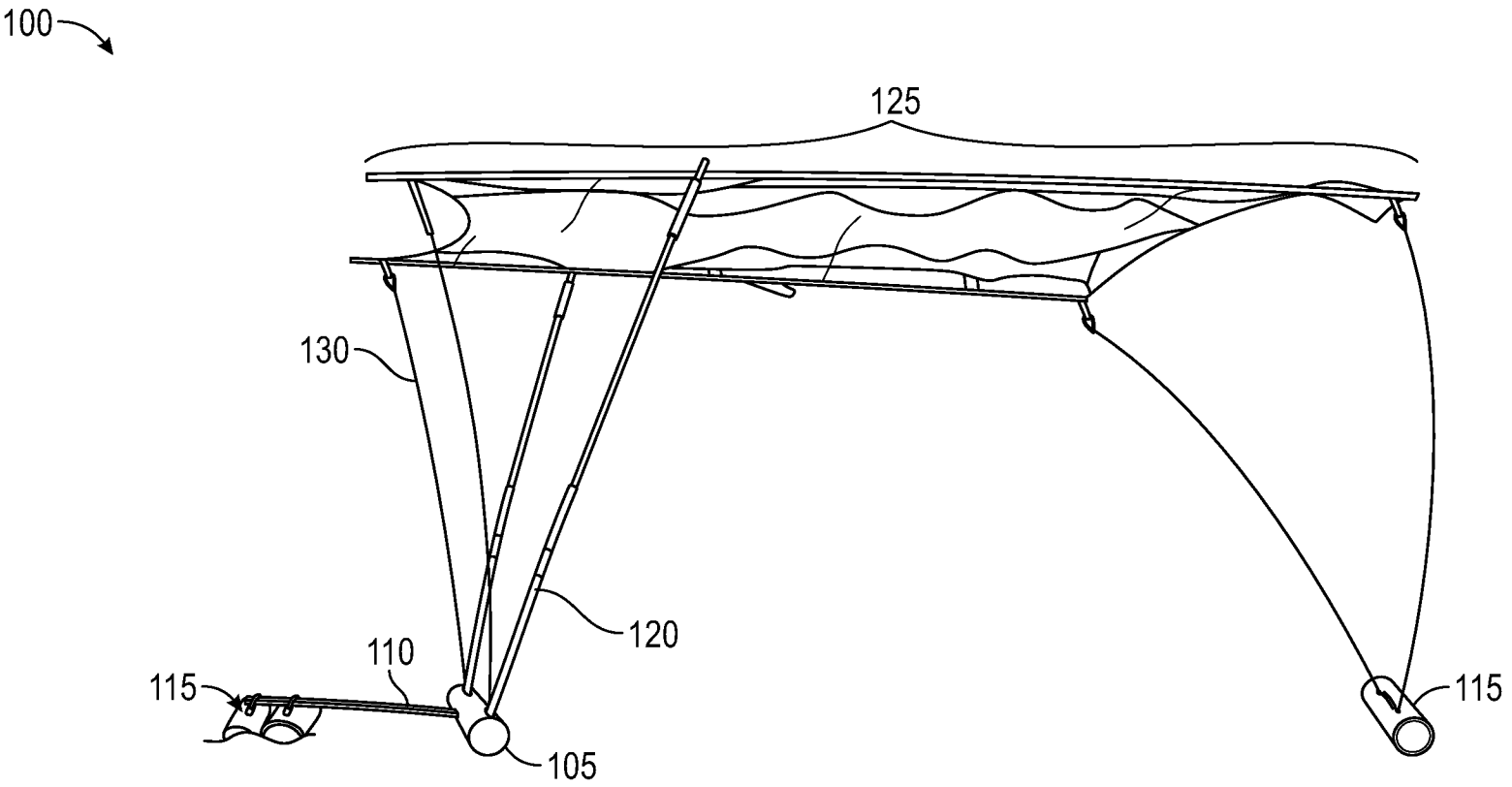
FIG. 1 illustrates a system embodying features consistent with the principles of the present disclosure.
Figure 2:
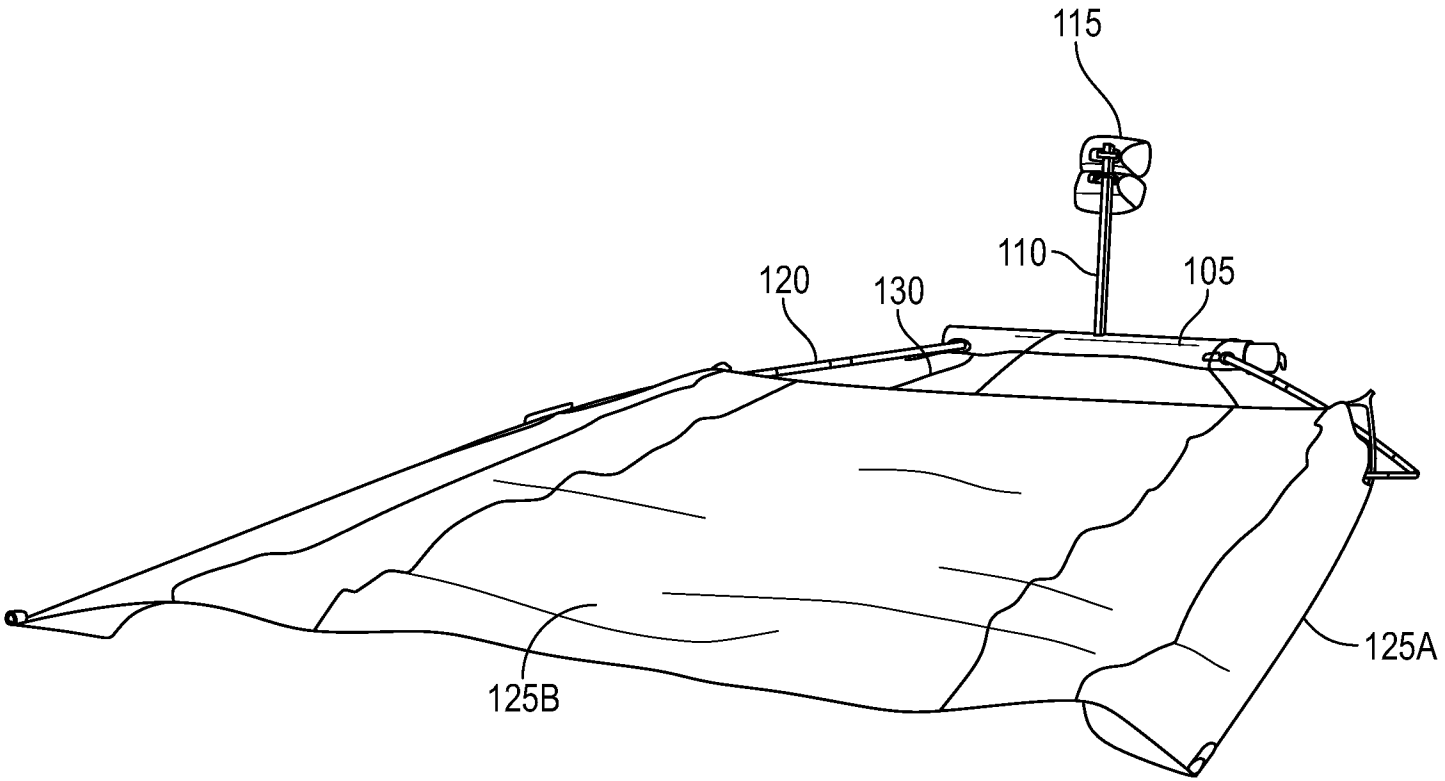
FIG. 2 illustrates a system embodying features consistent with the principles of the present disclosure.
Figure 3:
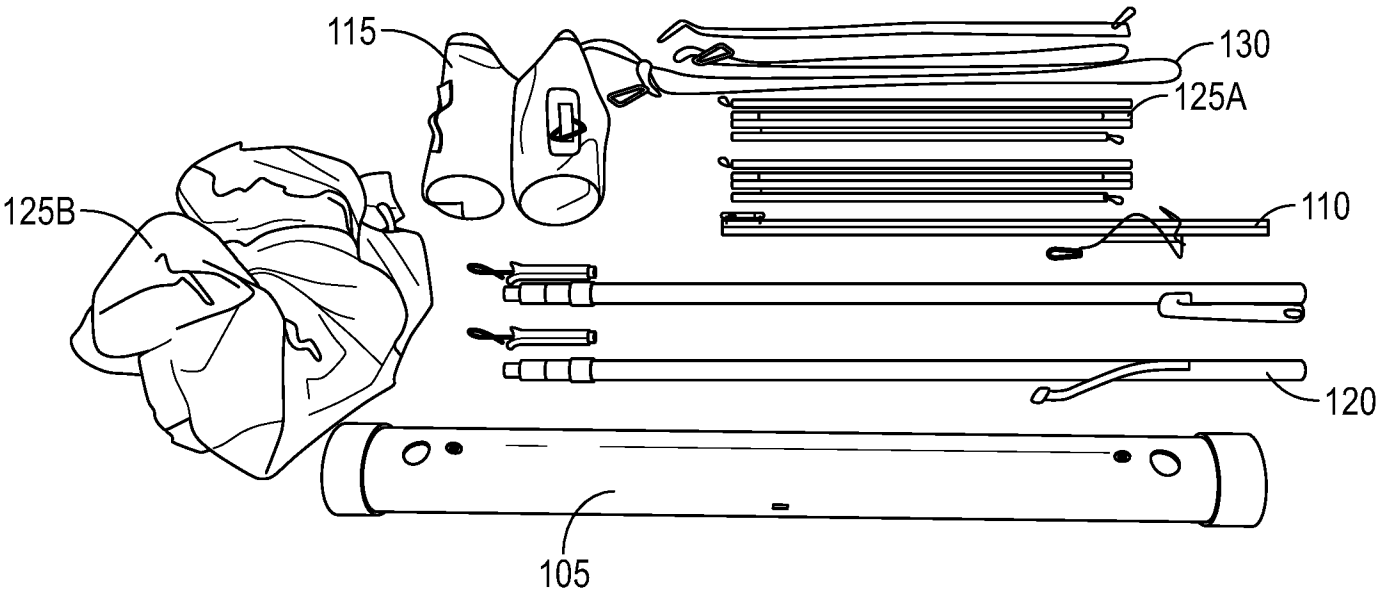
FIG. 3 illustrates a system embodying features consistent with the principles of the present disclosure.
Figure 4:
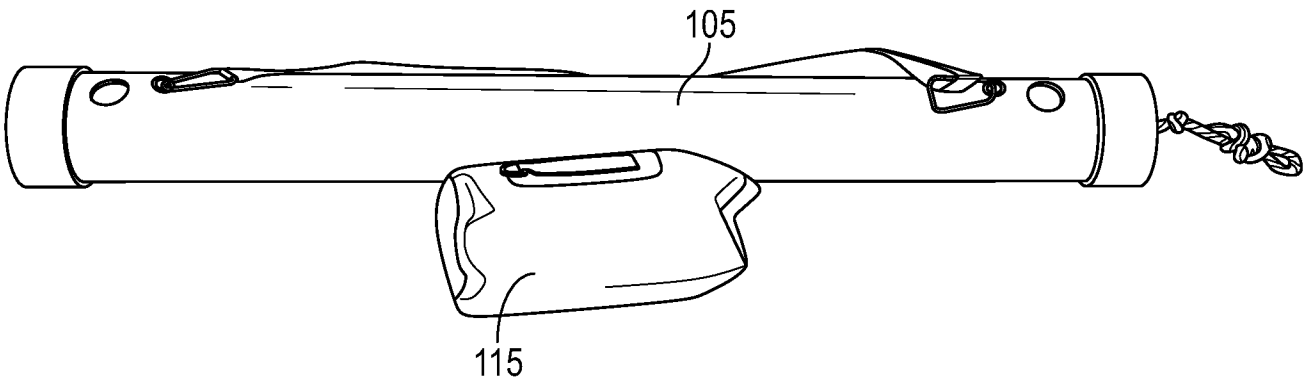
FIG. 4 illustrates a system embodying features consistent with the principles of the present disclosure.
Figure 5:
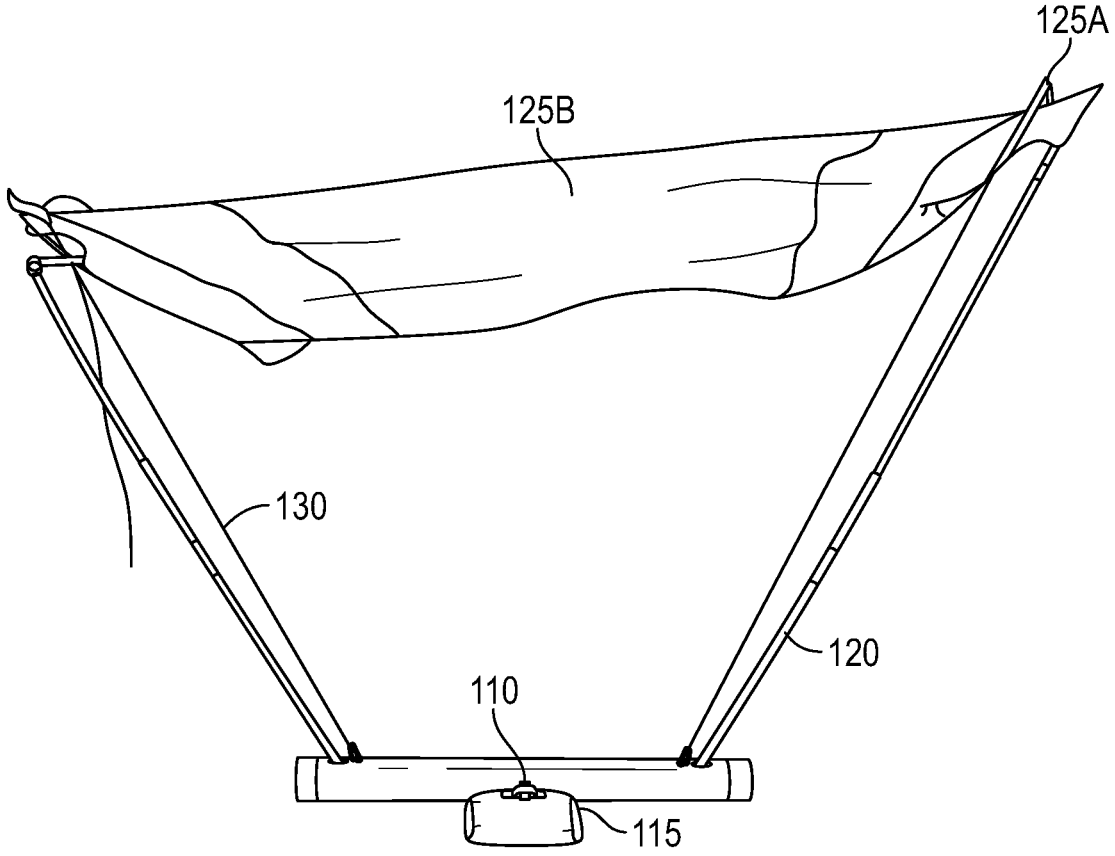
FIG. 5 illustrates a system embodying features consistent with the principles of the present disclosure.
Figure 6:
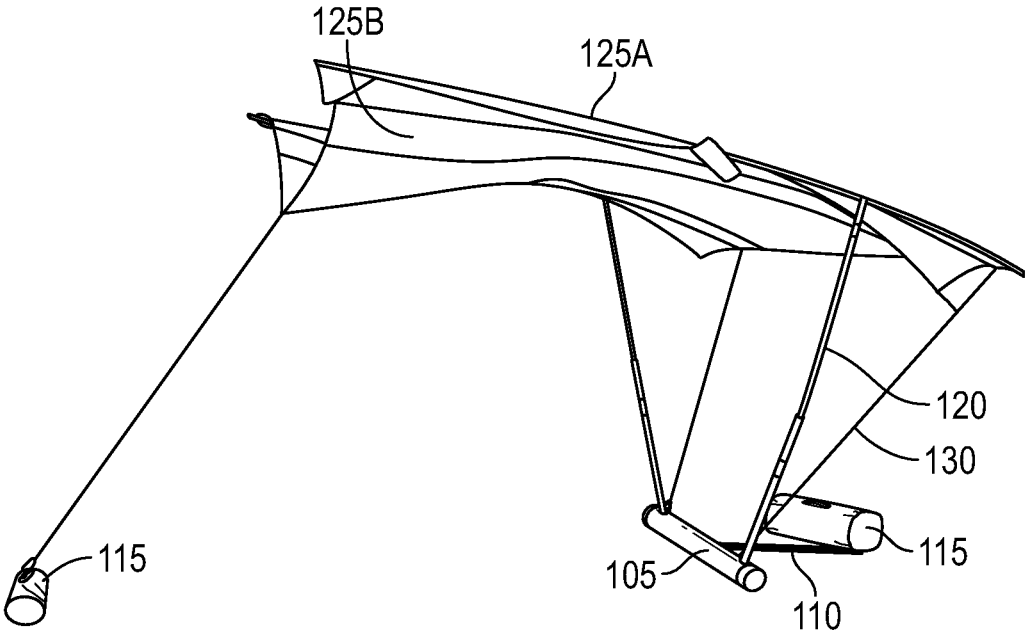
FIG. 6 illustrates a system embodying features consistent with the principles of the present disclosure.
Figure 7:
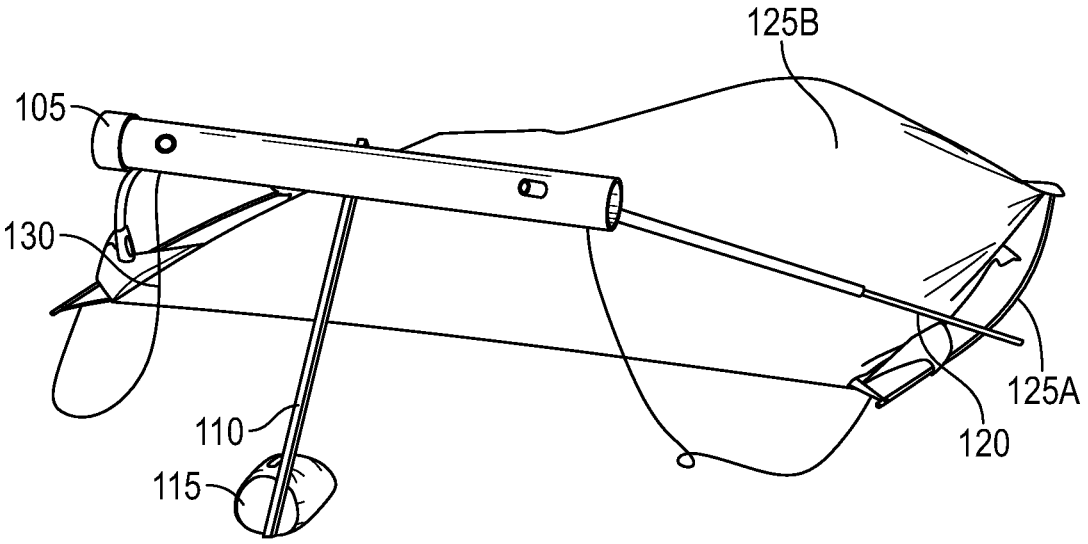
FIG. 7 illustrates a system embodying features consistent with the principles of the present disclosure.
Figure 8:
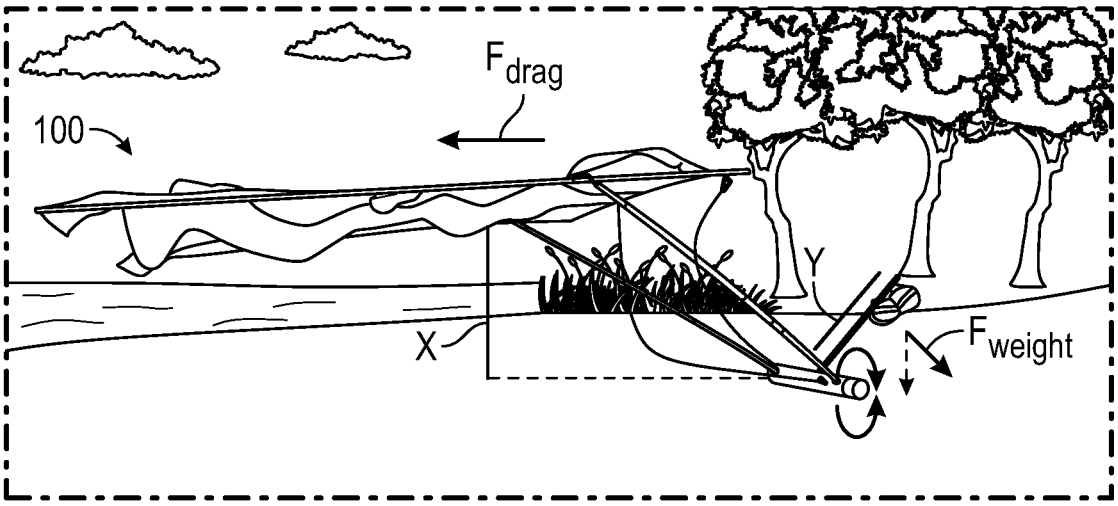
FIG. 8 illustrates a system embodying features consistent with the principles of the present disclosure being used within an environment.
Figure 9:
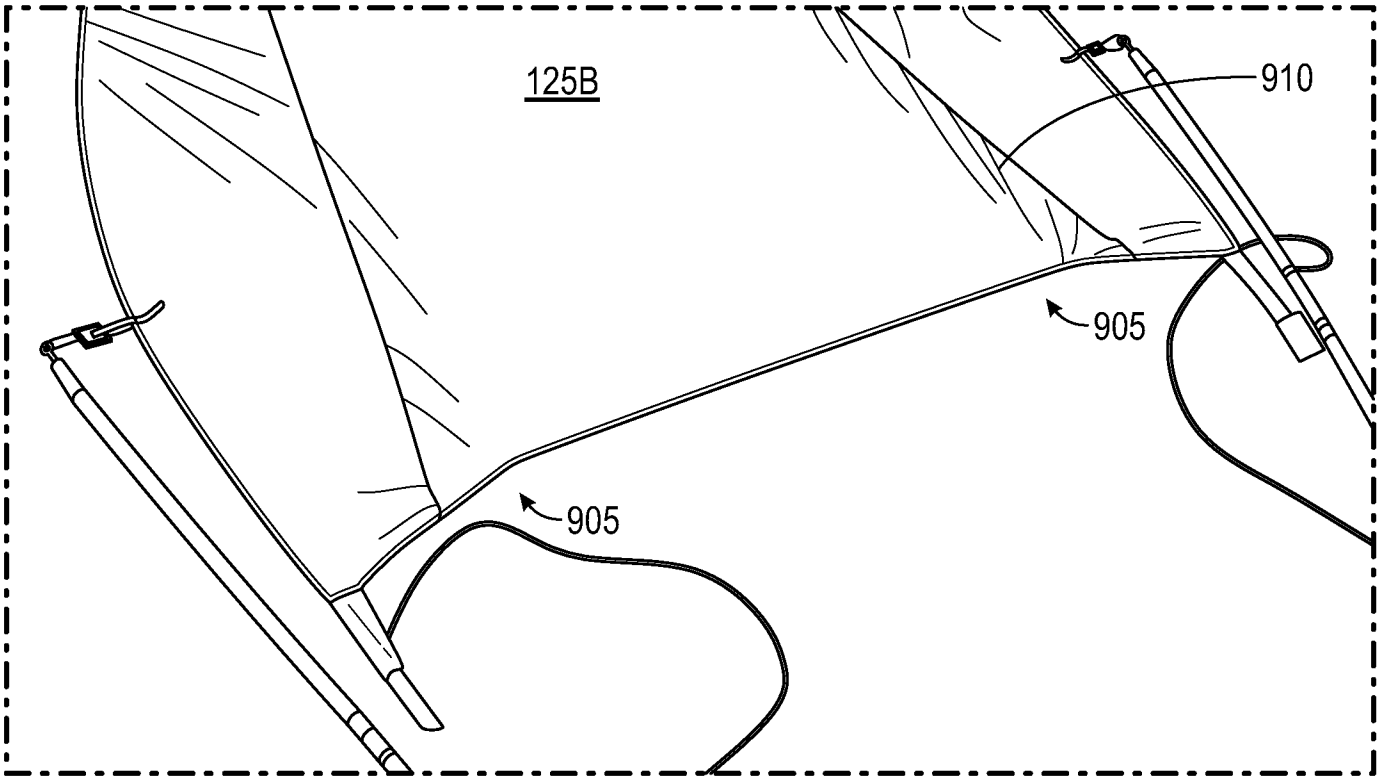
FIG. 9 illustrates a system embodying features consistent with the principles of the present disclosure.
Figure 10:
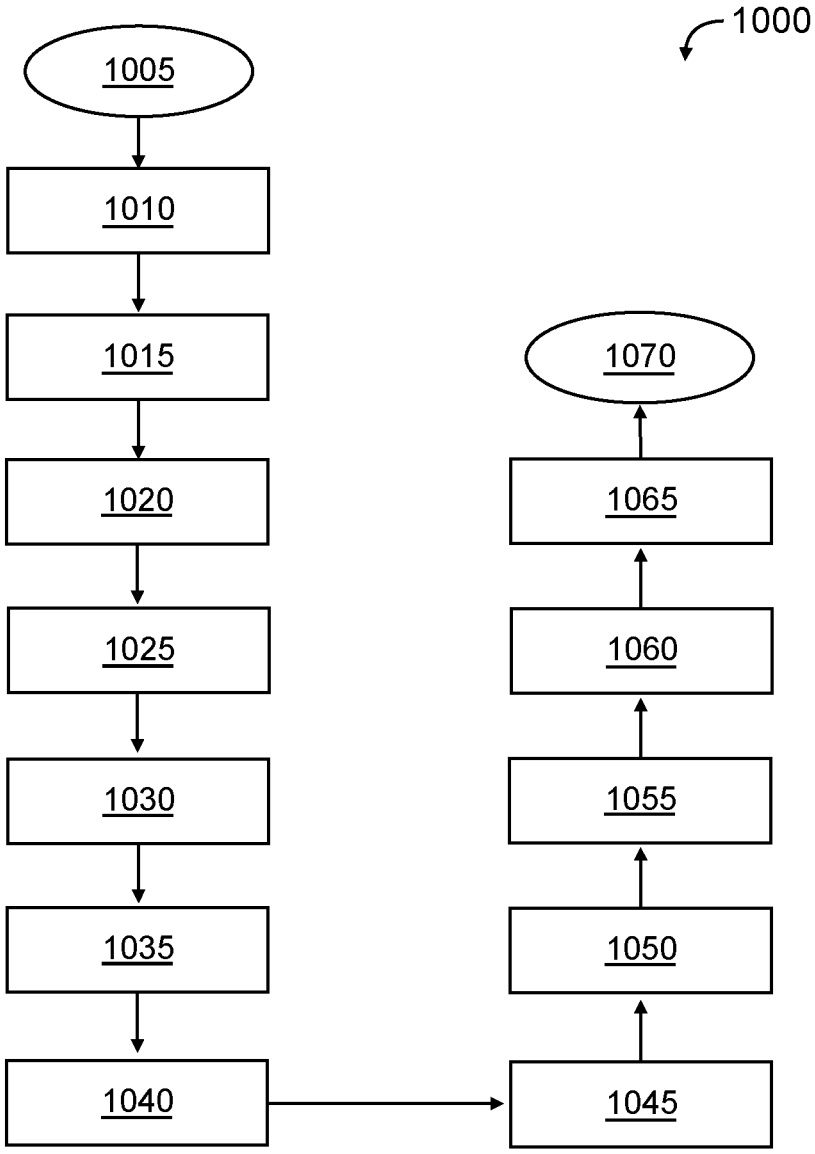
FIG. 10 illustrates a flow chart containing certain method steps of a method embodying features consistent with the principles of the present disclosure.

FIGS. 1-10 illustrate preferred embodiments of a system 100, or certain components thereof, that may be used as a dynamically orienting adjustable shelter. FIG. 1 illustrates a front perspective view of the system 100 and its various components. FIG. 2 illustrates a side perspective view of the system 100 and its various components in a grounded position 200. FIG. 3 illustrates an exploded view of the system 100. FIG. 4 illustrates an embodiment of the system 100 where the various components of the system 100 have been stored within the base 105 and counterweight 115 for transportation. FIG. 5 illustrates an embodiment of the system 100 having booms 120 at different heights to angle the canopy assembly 125. FIG. 6 illustrates an embodiment of the system 100 in an upright position 600 having a second counterweight 115 attached to the back end of the canopy 125B of the canopy assembly 125. FIG. 7 illustrates the system 100 in a flipped position 700. FIG. 8 illustrates an environmental view of how the system 100 may self-regulate in windy conditions. FIG. 9 illustrates a preferred embodiment of a canopy 125B having a tightened leading edge 905. FIG. 10 illustrates a flow diagraming 1000 outlining a method of assembling the system 100.

The system 100 generally comprises a base 105, lever arm 110, counterweight 115, boom 120, and canopy assembly 125. In one preferred embodiment, the system 100 may comprise cables 130 that may prevent the back end of the canopy assembly 125 from tilting too far down in conditions in which wind speeds are not high enough to allow the canopy 125B to be naturally supported in an upright position 600 by the wind. In another preferred embodiment, the system 100 may comprise a boom extension that may increase the length of the boom 120. In yet another preferred embodiment, the system 100 may comprise a plurality of tension straps that may be used to alter the amount of stress placed on the booms 120 as well as help adjust the angle of the canopy 125B. Although the system 100 disclosed herein has been discussed in terms of use for shelter in remote locations, one of skill in the art will appreciate that the inventive subject matter disclosed herein may be utilized in other fields or for other applications in which shelter may be needed. For instance, the system 100 could be used in tandem with outdoor furniture distributed about an outdoor pool area.

As illustrated in FIGS. 1-8, the base 105 comprises an extruded shape having a first end and a second end. In a preferred embodiment, the extruded shape is a cylindrical shape that allows the system 100 rotate in order to balance the various forces acting on the system 100. In another preferred embodiment, the extruded shape is a hexagon, which may prevent the base 105 from rolling when a control arm and boom 120 are not attached while still allowing for the base 105 to rotate when the torque created by the drag force acting on the canopy 125B, the canopy weight, and the boom 120 is balanced with the torque created by the counterweight 115 and the lever arm 110, wherein the drag force may become large enough at a certain wind velocity such that the torque created by the counterweight 115 and lever arm 110 may be overcome and the base 105 may rotate the canopy 125B back and eventually down. An outer wall of the base 105 comprises a plurality of apertures configured to accept various components of the system 100. In another preferred embodiment, the base 105 may comprise a tread device. The tread device may provide friction that may prevent the base 105 from sliding but still allow the base 105 to freely rotate as it reacts to the forces acting on the system 100. Devices that may act as a traction device include, but are not limited to, rubber treads, metal spikes, plastic cleats, or any combination thereof. In yet another preferred embodiment, the boom 120 and/or lever arm 110 may extend through the base 105 and act as the tread device. A tread device may be attached to the base end and/or bottom end of the lever arm 110 and boom 120, respectively, which may provide additional friction that may further prevent the base 105 from sliding while still allowing the base 105 to rotate.

In a preferred embodiment, a first aperture configured to fit a base end of the lever arm 110 and a second aperture configured to fit a bottom end of said boom 120 are spaced such that said lever arm 110 and said boom 120 form an angle between 90 and 110 degrees. Other embodiments may form an angle between the lever arm 110 and boom 120 that is less than 90 degrees so that the center of gravity of the counterweight is over the fulcrum of the base 105 when the canopy 125B is in a grounded position 200, as illustrated in FIG. 2. Materials that may be used to construct the base 105 include, but are not limited to, polymer, aluminum, wood, fiberglass, or any combination thereof. In one preferred embodiment, a central bore extending from a first end to a second end of said base 105 may create an internal cavity for the storage of certain components. End caps may be used to enclose the internal cavity, and at least one of said end caps are preferably removeable.

The lever arm 110 connects to the base 105 at said base end and extends away from said base 105. In a preferred embodiment, a lever arm 110 attaches to the base 105 via a first aperture located at a central point having an equal distance from the first end and second end of said base 105. The lever arm 110 preferably connects to said base 105 at approximately a 90-degree angle such that the center of gravity of a counterweight 115 attached to a weight end of said lever arm 110 is in a position extending outward from and approximately central to a central point of said base 105. Alternatively, a plurality of lever arms 110 may be positioned about said base 105 such that the center of gravity of a plurality of counterweights 115 attached to said plurality of lever arms 110 is in a position extending outward from and approximately central to a central point of said base 105. Materials that may be used to construct the lever arm 110 include, but are not limited to, polymer, aluminum, iron, steel, carbon fiber, wood, fiberglass, or any combination thereof.

In one preferred embodiment, the lever arm 110 is curved and/or angled such that the angle made between the counterweight 115 and boom 120 is less than 90-degrees. Should the canopy 125B and canopy support 125A contact the ground due to winds placing a larger drag force on the system 100 than the torque generated by the lever arm 110 and counterweight 115 can balance, the weight of the counterweight 115 will place a downward force on the boom 120 that may prevent the system 100 from assuming an upright position 600, thus locking the system 100 in this position. A user may reset the system 100 by moving the lever arm 110 and counterweight 115 until the weight of the counterweight 115 is no longer directly over said boom 120, which may allow the system 100 to reassume an upright position 600. Alternatively, the lever arm 110 may be curved and/or angled such that the angle made between the counterweight 115 and boom 120 is greater than 90-degrees, which may prevent the center of gravity of the counterweight 115 from crossing over the rotational fulcrum of the base 105. This may allow the system 100 to resume an upright position 600 when the drag force on the canopy 125B is lowered to a point that the torque created by the drag force acting on the canopy 125B, the canopy weight, and the boom 120 is less than or equal to the torque created by the counterweight and the lever arm 110.

The counterweight 115 attaches to the weight end of the lever arm 110 and creates a torque that acts on the system 100 as a balance to any drag force acting on the canopy 125B. In a preferred embodiment, the counterweight is a container made from a flexible material and configured to hold a substance, such as rocks, dirt, or sand. Because the torque generated by the lever arm 110 and counterweight 115 depends on both the length of the lever arm 110 and the weight of the counterweight 115, the weight of the counterweight 115 may vary. Generally, the weight of the counterweight 115 must be sufficient to balance the drag force acting on the canopy 125B and the weight of the canopy 125B so that the canopy assembly 125 may adjust about the boom 120 to expose the smallest cross section of the canopy 125B to the wind as possible, as illustrated in FIG. 8. In one preferred embodiment, the counterweight 115 may be removably attached to the lever arm 110 such that a user may remove the counterweight 115 prior to transportation of the system 100, as illustrated in FIG. 4.

In another preferred embodiment, the counterweight 115 may be incorporated into the lever arm 110 such that the lever arm 110 and counterweight 115 are a single unit. For instance, a lever arm 110 having a length of three feet and weight of twenty-five pounds may have a center of gravity that is significantly skewed towards the weight end so that the weight end may act as a counterweight 115 for the system 100. In yet another preferred embodiment, the counterweight 115 may comprise a container that may be filled with a substance, which may allow a user to reduce the weight of the counterweight 115 while the user is transporting the system 100 to a desired location and increase the weight when the user assembles the system 100 by filling the container with said substance. For instance, a user may transport the system 100 to a beach and then fill a container with sand once they have reached a desired location. When the user is ready to break down the system 100, the user may empty the container for easier transport.

In yet another preferred embodiment, a second counterweight 115 may be attached to the back end of the canopy assembly 125, as illustrated in FIGS. 1 and 6. When wind is blowing in the opposite direction in which the lever arm 110 and counterweight 115 are pointing, the second counterweight 115 may act as an anchor that may prevent the device from flipping. Though the canopy 125B of a system 100 in a flipped position 700 will be grounded, as illustrated in FIG. 7, the addition of a second counterweight 115 may be enough to prevent the system 100 from flipping all together. In a preferred embodiment, the second counterweight 115 is attached to the canopy supports 125A of the canopy assembly 125, as illustrated in FIG. 1; however, the second counterweight 115 may be attached to the canopy 125B of the canopy assembly 125 as well, as illustrated in FIG. 6. In yet another preferred embodiment, a third counterweight 115 may be added to either or both ends of the base 105, which may prevent the system 100 from blowing over sideways when exposed to a crosswind. Instead, the drag force created by the crosswind may cause the system 100 to rotate until the front end of the system 100 is facing the crosswind, allowing the system 100 to act as intended.

The boom 120 attaches to the base 105 at said bottom end and extends away from said base 105. In one preferred embodiment, the boom 120 is foldable and comprises a plurality of tubular sections arranged about an elastic cord, wherein said tubular sections have interlocking ends that allow said tubular sections to be combined to create a single boom 120. In another preferred embodiment, the boom 120 is telescoping to minimize the space occupied by the boom 120 when not in use. The telescoping boom 120 may be locked into a plurality of lengths, allowing a user to adjust the height of the canopy assembly 125 by adjusting the height of the boom 120. This also may affect the torque created by the drag force acting on the canopy 125B, the weight of the canopy 125B, and the boom 120 since the reduced/increased length of the boom 120 will reduce/increase the amount of torque, respectively. In another preferred embodiment, a user may adjust the height of a first boom 120 higher than the height a second boom 120, which may cause the canopy 125B to no longer be generally parallel with the ground, as illustrated in FIG. 5. This may allow a user to angle the canopy 125B in a way that blocks sunlight when the sun is lower in the sky. Because the tensions straps connecting the canopy supports 125A to the boom 120 are flexible, the system 100 may still work as intended since the canopy assembly 125 will still attempt to naturally reduce the cross-sectional area exposed to the wind despite the different angle of canopy assembly 125.

Materials that may be used to construct the boom 120 include, but are not limited to, polymer, aluminum, iron, steel, carbon fiber, wood, fiberglass, or any combination thereof. In a preferred embodiment, a first boom 120 and a second boom 120 attach to the base 105 via a first boom 120 aperture and second boom 120 aperture having x, y, z coordinates that differ only in the value of z, wherein the z-axis extends centrally through said base 105 from said first end to said second end. The first boom 120 apertures and second boom 120 aperture are preferably located equal distances from the first end and the second end of the base 105 so that drag force acting on the base 105 via the canopy 125B through the canopy support 125A and boom 120 generally creates a force vector that is located about a central plane of said system 100. The angle created by said boom 120 and said lever arm 110 allows the canopy support 125A to be supported at an elevated position at a canopy 125B end of said boom 120.

The canopy assembly 125 may comprise a canopy 125B and canopy supports 125A. The canopy 125B may be defined as a tensile structure that may provide shelter when attached to the canopy supports 125A. The canopy supports 125A may be defined as rigid beams to which a canopy 125B may be attached. In a preferred embodiment, the canopy supports 125A comprise a first canopy support 125A attached to a first side of said canopy 125B and a second canopy support 125A attached to a second side of said canopy 125B. Materials that may be used to make the canopy supports 125A include, but are not limited to, polymer, aluminum, iron, steel, carbon fiber, fiber glass, wood, or any combination thereof. In a preferred embodiment, the canopy supports 125A are foldable and comprise a plurality of tubular sections arranged about an elastic cord, wherein said tubular sections have interlocking ends that allow said tubular sections to be combined to create a single tubular support. In another preferred embodiment, the canopy supports 125A may be telescoping. Materials that may be used to make the canopy 125B include, but are not limited to, mesh, nylon, polyester, cotton, canvas, or any combination thereof. In a preferred embodiment, the canopy 125B is water-resistant or water-proof such that it may provide protection from the elements when in wet conditions. In another preferred embodiment, the canopy 125B may have an ultraviolet protection factor (UPF) such that it may provide protection from ultraviolet light in sunny conditions.

The canopy supports 125A are preferably attached to the canopy 125B via a plurality of attachment elements situated about the length of the canopy supports 125A. In a preferred embodiment, the width of the canopy assembly 125 is less than the width of the space between the canopy 125B ends of the first boom 120 and second boom 120. When the first canopy support 125A is connected to the first boom 120 and the second canopy support 125A is connected to the second boom 120, the stress placed on the first boom 120 and second boom 120 force the first canopy support 125A and second canopy support 125A away from one another, which in turn cause the canopy 125B to become taut. In a preferred embodiment, the canopy assembly 125 is attached to the boom 120 via an attachment element. In an alternative embodiment, a single boom 120 attached to the base 105 via a centrally located single boom 120 aperture may attach to a bracket of canopy 125B. A plurality of batten sleeves of the canopy 125B may allow for canopy supports 125A in the form of battens to be inserted into the canopy 125B to make the canopy 125B taut. Alternatively, a "T" rod connecting the central boom 120 to the canopy supports 125A could be used to push apart the canopy 125B rods, causing the canopy 125B to become taut.

As illustrated in FIG. 9, some preferred embodiments of the canopy 125B may further comprise a tightened leading edge 905 that is preferably taut when the canopy 125B is secured to the canopy supports 125A. In one preferred embodiment, the leading edge 905 is tightened in a way that causes the material of the canopy 125B to form ripples 910 when said canopy 125B is attached to the canopy supports 125A. Incorporating a tightened leading edge 905 into the canopy increases stability of the system 100 by generally causing the canopy 125B to hold a shape that is flatter in higher wind conditions. This tightened leading edge 905 also allows the canopy 125B to cut through the wind more consistently, further increasing stability of the system 100. Additionally, reducing the amount of flapping in the material of the canopy 125B increases the mechanical life of the canopy 125B since excessive flapping of the material causes it to break down faster. Ways in which the leading edge 905 may be tightened include, but are not limited to, an internal cord, a strap along the front, rolled and sewn leading edge material, or any combination thereof.

In a preferred embodiment, tension straps connecting the canopy supports 125A to said attachment elements may allow a user to increase or decrease the stress on the booms 120 by increasing or decreasing the length of the tension straps, which in turn may increase or decrease the width of the canopy assembly 125. For instance, by increasing the length of the tension straps, a user may increase the total width of the canopy assembly 125 such that it is wider than the distance between the first boom 120 and second boom 120. This in turn decreases the stress acting on the first boom 120 and second boom 120 since first boom 120 and second boom 120 are no longer bent towards one another. In another preferred embodiment, tension straps connecting the booms 120 to said attachment elements may further allow a user to increase or decrease the stress on the first boom 120 and second boom 120 in the same manner as above.

The first boom 120 and second boom 120 are preferably attached to the canopy supports 125A of the canopy assembly 125 at an attachment point off center and towards the front end of the canopy assembly 125. Should the weight of the canopy assembly 125 be evenly distributed, attachment in this manner will cause the back end of the canopy support 125A to tilt downwards, creating a cross sectional surface on which wind may produce drag. The further off center and towards the front end the attachment point is on the canopy assembly 125, the greater the tilt and the larger the cross-sectional area on which wind may act on the canopy assembly 125. However, in instances where wind is not strong enough to create enough drag to greatly affect the downward tilt of the canopy 125B, a user sitting beneath the canopy assembly 125 may have an obstructed view. In one preferred embodiment, a cable 130 may be attached to the front end of the canopy support 125A, which may prevent the back end of the canopy 125B from tilting too far downward when there is not enough wind that the system 100 may use to stabilize the canopy 125B by naturally reducing the cross-sectional area exposed thereto. Alternatively, the cable 130 may be attached to the boom 120 or lever arm 110.

FIG. 10 depicts a flow chart 1000 illustrating certain, preferred method steps that may be used to carry out the method of assembling the system 100. Step 1005 indicates the beginning of the method. During step 1010, a user having the system at a desired location may remove an end cap of said base 105. The user may then remove the canopy supports 125A, canopy 125B, counterweight 115, lever arm 110, and booms 120 from the cavity during step 1015. The user may then attach the leaver arm to the base 105 during step 1020. Once the lever arm 110 has been attached, the user may determine a direction of wind during step 1025. The user may then point the lever arm 110 attached to the base 105 towards said direction of wind during step 1030.

The user may attach the booms 120 to the base 105 during step 1035. The user may then place the base 105, lever arm 110, and booms 120 in a desired assembly position during step 1040. In a preferred embodiment, a user may place the base 105, lever arm 110, and booms 120 in a grounded position 200. Once the base 105, lever arm 110, and booms 120 are in a desired assembly position, the user may attach the canopy supports 125A to the canopy 125B during step 1045 to create the canopy assembly 125. The user may then attach the canopy assembly 125 to the booms 120 during step 1050. The counterweight 115 is to be filled with a substance until a desired weight is obtained during step 1055. In a preferred embodiment, the substance is sand. Once filled, the user may attach the counterweight 115 to the lever arm 110 during step 1060. The user may then place the system 100 in an upright position 600 during step 1065 before heading to terminate step 1070. Some preferred embodiments of the system may include cables 130 designed to prevent the canopy assembly 125 from tilting too far forward or cables 130 and/or counterweights 115 designed to prevent the system 100 from assuming a flipped position 700. These cables 130 and/or additional counterweights 115 may be attached by the user before or after placing the system 100 in an upright position 600.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter can be made without departing from the principles and scope of the inventive subject matter.

What is claimed is:

1. A system for providing shelter comprising, a base configured to rotate in response to a difference in torque, a first boom attached to said base at a first end of said base, a second boom attached to said base at a second end of said base, a counterweight secured to said base via a lever arm, wherein said lever arm is attached to said base between said first boom and said second boom, wherein said counterweight and said lever arm create said torque that acts on said base, wherein an angle created between said lever arm and said first boom and said angle created between said lever arm and said second boom is such that said first boom and said second boom are in an elevated position when at least one of said counterweight and said lever arm are in contact with a support surface, and a canopy assembly functionally connected to said first boom and said second boom, wherein said canopy assembly may rotate about said first boom and said second boom to provide a smallest cross-section in a direction of wind, wherein said direction of wind acts on said smallest cross-section to create a drag force.

2. The system of claim 1, wherein said torque created by said drag force, canopy assembly, first boom, and said second boom is opposed by said torque created by said counterweight and said lever arm.

3. The system of claim 2, wherein said torque created by said drag force, canopy assembly, first boom, and said second boom causes said canopy assembly to move towards a grounded position when greater than said torque created by said counterweight and said lever arm.

4. The system of claim 2, wherein said torque created by said counterweight and said lever arm causes said canopy assembly to move towards an upright position when greater than said torque created by said drag force, canopy assembly, first boom, and said second boom.

5. The system of claim 1, further comprising at least one cable configured to prevent a back end of said canopy assembly from tilting lower than a length of said at least one cable would allow, wherein said at least one cable is attached to a front end of said canopy assembly and at least one of said base, first boom, second boom, and lever arm.

6. The system of claim 1, wherein said counterweight is a flexible container, wherein said flexible container is filled with a substance to provide a desired weight.

7. The system of claim 1, further comprising a second counterweight attached to said canopy assembly, wherein said second counterweight prevents said canopy assembly from moving towards a flipped position.

8. The system of claim 1, wherein said canopy assembly is connected to said first boom at a first canopy support and said second boom at a second canopy support in a way such that stress created between said first boom and said second boom causes said first canopy support and said second canopy support to move in an opposite direction.

9. The system of claim 1, wherein said canopy further comprises a tightened leading edge, wherein said tightened leading edge increases stability of said canopy assembly, wherein said tightened leading edge reduces flapping of material of said canopy.

10. A system for providing shelter comprising, a base having a first aperture and a second aperture, wherein at least one of a first end and a second end of said base comprises an end cap, wherein said end cap removably attaches to said base in way such that a cavity of said base is accessible, a lever arm removably attached to said base via said first aperture, wherein said lever arm and a counterweight secured to said lever arm create torque that acts on said base, wherein said lever arm and said counterweight are configured to break down such that said lever arm and said counterweight will fit within said cavity of said base, a boom removably attached to said base via said second aperture, wherein said boom is configured to break down such that said boom fits within said cavity of said base, and a canopy assembly removably attached to said boom, wherein said canopy assembly is configured to rotate about said boom such that a smallest cross-section is provided in a direction of wind, wherein said canopy assembly is configured to break down such that said canopy assembly fits within said cavity of said base.

11. The system of claim 10, wherein said torque created by said canopy assembly, boom, and a drag force acting on said canopy assembly is opposed by said torque created by said counterweight and said lever arm.

12. The system of claim 11, wherein said torque created by said canopy assembly, boom, and drag force acting on said canopy assembly causes said canopy assembly to move towards a grounded position when greater than said torque created by said counterweight and said lever arm.

13. The system of claim 11, wherein said torque created by said counterweight and said lever arm causes said canopy assembly to move towards an upright position when greater than said torque created by said canopy assembly, boom, and drag force acting on said canopy assembly.

14. The system of claim 10, further comprising at least one cable configured to prevent a back end of said canopy assembly from tilting lower than a length of said at least one cable would allow, wherein said at least one cable is attached to a front end of said canopy assembly and at least one of said base, boom, and lever arm.

15. The system of claim 10, wherein said counterweight is a flexible container, wherein said flexible container is filled with a substance to provide a desired weight.

16. The system of claim 10, further comprising a second counterweight attached to said canopy assembly, wherein said second counterweight prevents said canopy assembly from moving towards a flipped position.

17. The system of claim 10, wherein said canopy assembly is connected to said boom in a way such that stress created by said boom causes a first canopy support and a second canopy support to move in an opposite direction.

18. The system of claim 10, wherein said canopy further comprises a tightened leading edge, wherein said tightened leading edge increases stability of said canopy assembly, wherein said tightened leading edge reduces flapping of material of said canopy.

19. A method for assembling a dynamically orienting adjustable shelter comprising steps of, obtaining a dynamically orienting adjustable shelter, obtaining a desired location on which to assemble said dynamically orienting adjustable shelter, determining a direction of wind at said desired location, placing a base of said dynamically orienting adjustable shelter on a support surface at a desired location, wherein said base is oriented such that a first aperture of said base is pointed into said direction of wind, attaching a lever arm to said base via said first aperture of said base, attaching a first boom to said base at a first end of said base, attaching a second boom to said base at a second end of said base, attaching a canopy assembly to said first boom and said second boom, attaching a counterweight to said lever arm, and rotating said lever arm and said counterweight towards said support surface to place said dynamically orienting adjustable shelter in an upright position.

20. The method of claim 19, further comprising the steps of:

removing an end cap of said base to access a cavity of said base, wherein said lever arm, counterweight, first boom, second boom, and canopy assembly are located within said cavity, and removing said lever arm, counterweight, first boom, second boom, and canopy assembly from said cavity.

21. The method of claim 19, further comprising the steps of:

attaching a first canopy support and a second canopy support to a canopy to create said canopy assembly.

22. The method of claim 19, further comprising the steps of:

filling said counterweight with a substance until a desired weight is obtained.

* * * * *